US006678921B2

(12) United States Patent
Despault et al.

(10) Patent No.: US 6,678,921 B2
(45) Date of Patent: Jan. 20, 2004

(54) PRE-CRIMPED TIE COMPONENTS

(75) Inventors: Marc P. Despault, Ottawa (CA); James Harrison, Kanata (CA)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 10/263,502

(22) Filed: Oct. 3, 2002

(65) Prior Publication Data

US 2003/0033693 A1 Feb. 20, 2003

Related U.S. Application Data

(63) Continuation of application No. PCT/US01/09934, filed on Mar. 28, 2001.

(60) Provisional application No. 60/259,974, filed on Jan. 5, 2001, and provisional application No. 60/194,163, filed on Apr. 3, 2000.

(51) Int. Cl.[7] ..... B65D 63/00; B32B 3/02

(52) U.S. Cl. ..... 24/16 PB; 24/30.5 T; 24/16 R; 24/26; 24/29; 24/20 S; 24/548; 24/562; 204/196.01; 204/196.02

(58) Field of Search ..... 24/30.5 T, 16 PB, 24/16 R, 17 B, 20 R, 20 S, 26, 27, 29, 546, 548, 562; 204/196.01, 196.02

(56) References Cited

U.S. PATENT DOCUMENTS

| | | | | | |
|---|---|---|---|---|---|
| RE8,094 | E | * | 2/1878 | Hagins | 24/16 R |
| ,298,645 | A | * | 5/1884 | White | 24/26 |
| ,620,664 | A | * | 3/1899 | Nissim | 24/16 R |
| ,672,977 | A | * | 4/1901 | Cronenberger | 24/26 |
| ,889,169 | A | * | 5/1908 | Alverson et al. | 24/26 |
| 2,377,810 | A | | 6/1945 | Robbins | |
| 2,800,170 | A | | 7/1957 | Richardson | |
| 2,855,713 | A | * | 10/1958 | Jaremo | 24/20 S |

(List continued on next page.)

FOREIGN PATENT DOCUMENTS

| | | |
|---|---|---|
| EP | 0130106 | 1/1985 |
| FR | 1529842 | 11/1968 |
| JP | 10017009 | 1/1998 |
| WO | 9719584 | 6/1997 |

*Primary Examiner*—Victor Sakran
(74) *Attorney, Agent, or Firm*—Volpe and Koenig, P.C.

(57) ABSTRACT

A tie component comprising first and second pre-crimped portions. Each pre-crimped portion has a plurality of alternating indentations and projections. The pre-crimped portions are joined by alignment and relative movement with respect to one another such that at least one of the first portion projections engages at least one of the second portion indentations and at least one of the second portion projections engages at least one of the first portion indentations.

10 Claims, 3 Drawing Sheets

U.S. PATENT DOCUMENTS 3,023,037 A * 2/1962 Sandor ..... 24/29
3,238,594 A 3/1966 Schuster
3,308,856 A 3/1967 Ploss
3,567,569 A 3/1971 Ono et al.
3,622,415 A 11/1971 Kunsman
3,654,049 A * 4/1972 Ausnit ..... 24/16 PB
3,723,240 A 3/1973 Skochdopole et al.
3,836,416 A 9/1974 Ropiequet
3,882,573 A * 5/1975 Thomas, Jr. ..... 24/30.5 T
4,054,993 A 10/1977 Kamp et al.
4,079,484 A * 3/1978 Nakama ..... 24/16 PB
4,123,022 A 10/1978 Dutt et al.
4,186,239 A 1/1980 Mize et al.
4,229,501 A 10/1980 Kern
4,349,198 A 9/1982 Stelck
4,395,308 A 7/1983 Dawes
4,410,015 A 10/1983 Koller et al.
4,415,625 A 11/1983 Borel
4,435,102 A * 3/1984 Smith ..... 403/206
4,529,013 A 7/1985 Miller
4,581,794 A 4/1986 Oldroyd et al.
4,585,487 A 4/1986 Desteree et al.
4,661,404 A 4/1987 Black
4,797,313 A * 1/1989 Stolk et al. ..... 24/30.5 T
4,846,231 A 7/1989 Penven
4,861,660 A 8/1989 Ishii
4,974,302 A 12/1990 Nabulon
5,187,845 A 2/1993 Duffy et al.
5,220,774 A 6/1993 Harbeke et al.
5,268,076 A 12/1993 Best et al.
5,795,835 A * 8/1998 Bruner et al. ..... 442/310
5,968,651 A 10/1999 De Vos et al.
5,989,683 A 11/1999 Haddock et al.
6,045,884 A 4/2000 Hess et al.
6,045,911 A 4/2000 Legrand et al.
6,058,541 A 5/2000 Masterman et al.
6,079,087 A 6/2000 Cansler
6,088,891 A 7/2000 Cohrt et al.
6,311,466 B1 11/2001 De Vos et al.

* cited by examiner

PRE-CRIMPED TIE COMPONENTS

This application is a continuation of PCT International Application No. PCT/US01/09934, filed on Mar. 28, 2001, which claims the benefit of U.S. Provisional Application No. 60/194,163, filed on Apr. 3, 2000 and U.S. Provisional Application No. 60/259,974, filed on Jan. 5, 2001.

BACKGROUND

The present invention relates to tie components. More particularly, the present invention relates to tie components manufactured from pre-crimped yarns.

Tie components come in various forms and are used in many applications. For example, segments of metal wire, whether coated or uncoated, are often used for twist ties. The twist ties can be used, for example, for closing a package or bag, or joining two members together. Another form of tie includes a strip with a securing member at one end and an opposite toothed end, or the like, which is received through and retained by the securing member. Such ties are often used for clothes tags or cable ties and are typically permanent such that the tie must be fractured for removal. Other tie components may include hook and loop type fasteners, for example Velcro® brand fastening material, for forming strips which can be looped around and secured. Other tie component types are known and used.

While each of these ties has proven effective in certain uses, each also has limitations. For example, some of the ties provide minimal load strength, others are limited in size, others are difficult or expensive to manufacture, while others may be useful only in a limited range of environmental conditions due to deleterious effects of temperature, humidity or the presence of contaminants. Others cannot be opened without permanently destroying the tie so that it cannot be reused. The present inventors have found that many, if not all of these limitations, can be overcome in a single tie component, namely, a tie component manufactured from a pre-crimped material.

Pre-crimped yarns are known. U.S. Pat. Nos. 2,377,810; 3,567,569; 3,836,416; 4,661,404; 4,974,302; 5,187,845; 6,045,911; 6,058,541; 6,079,087 and 6,088,891 all disclose methods of forming pre-crimped yarns. The uses of such pre-crimped yarns vary. U.S. Pat. Nos. 2,377,810; 3,567,569 and 4,661,404 disclose methods of manufacturing crimped yarns for woven or knitted synthetic fabrics, for example synthetic fabrics having the look of silk and the properties of wool. U.S. Pat. No. 3,836,416 discloses a method of manufacturing undulating yarns which are fused together to form plastic sheet material. U.S. Pat. No. 5,187,845 discloses a method of forming pre-crimped yarns for use in carpet products. U.S. Pat. Nos. 6,058,541 and 6,079,087 disclose methods of forming crimped yarns for use in toothbrushes and paintbrushes, respectively. U.S. Pat. No. 6,045,911 discloses a cutting filament for use in a rotary cutter such as a grass trimmer. Various crimp shapes are disclosed. While pre-crimped components have been known, none of these references teaches or suggests use of pre-crimped yarns as tie components.

SUMMARY

The present invention relates to tie components manufactured from a length of material having pre-crimped portions of alternating projections and indentations. The tie component is arranged in a desired configuration and joined by aligning and twisting two pre-crimped portions into registry whereby they interlock. The tie component can be used for many consumer end uses, for example, cable and hose ties, suspended ceiling ties, plant hangers and/or vegetable stakes, pole ties for signage, peg board tool holders, or as a general fastener anywhere a twist-tie or the like may be used. The components, which may be any desired length, are preferably manufactured from a synthetic material, but may be manufactured from metal or other materials.

DETAILED DESCRIPTION OF THE PREFERRED EMBODIMENTS

The present invention will be described with reference to the accompanying drawing figures where like numerals represent like elements throughout.

As used herein, the term "component" encompasses monofilaments, multifilaments, strips slit from film, or other similar yarn like elements whose length dimension is greater than either their height or width. The term "crimp" refers to the waviness or distortion of a component from a common center as is known in the art. Crimp may be imparted to a component by interlacing it with at least one other component during the assembly of a textile, such as by weaving or knitting, through a "stuffer box" process, by casting or molding the component using an appropriate mold, by thermoforming or other methods. The term "thermoforming" relates to a process for imparting a specific crimp to a thermoplastic component by mechanical means with or without a thermal treatment; for example, by passing the components through chilled or heated gears, rollers or plates or by passing them through gears, rollers or plates and then subsequently heating or cooling so as to permanently deform them in a desired manner. The term "pre-crimped" refers to a treatment which imparts a desired crimp to a component prior to its incorporation into a product. As used herein, both pre-crimping and thermoforming impart specifically dimensioned indentations to the components allowing them to be interlocked with a desired fit.

Figure 1:
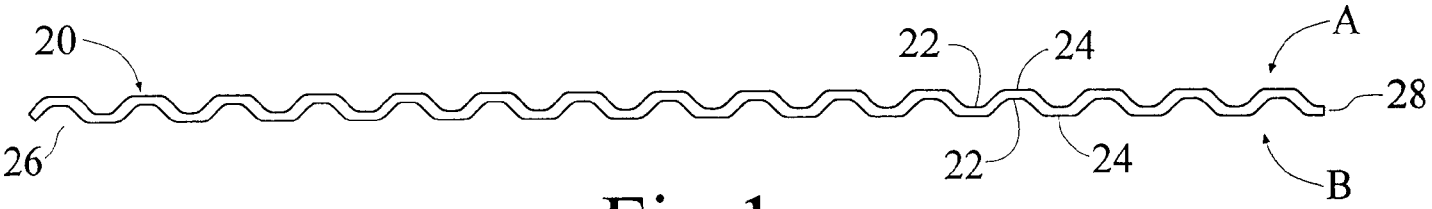
FIG. 1 is a side elevational view of a pre-crimped component in accordance with the present invention.

Referring to FIG. 1, a first embodiment of the tie component 20 of the present invention is shown. The tie component 20 is pre-crimped such that each surface A and B has a series of alternating indentations 22 and projections 24. The alternating indentations 22 and projections 24 may be provided along the entire length of the component 20, as shown, or only along desired portions. Additionally, while the illustrated embodiment has a rectangular cross-section, see FIG. 4, the component, 20 can have any desired cross-section, for example, circular, oval or any polygonal shape. The components 20 are preferably manufactured from a synthetic material, for example, nylon, polyethylene terephthalate (PET) and related polymers and copolymers, polybutylene terephthalate (PBT), polyphenylene sulfide (PPS), polyetheretherketone (PEEK), poly (cyclohexanedimetlylene terephthalate) (PCTA), and other polymers used in e.g. industrial textiles. The components may also be manufactured from other suitable polymeric materials, metals or other materials, having the desired properties. The tie component 20 can be supplied in precut lengths or it can be spooled such that a user can cut a piece to a desired length for a particular application.

Figure 2:
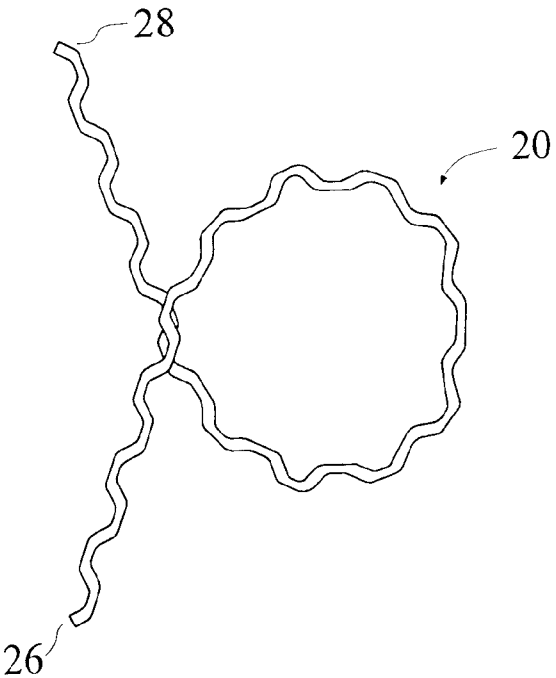
FIG. 2 is a side elevational view of the pre-crimped component of FIG. 1 with its ends crossed prior to intertwining.
Figure 3:
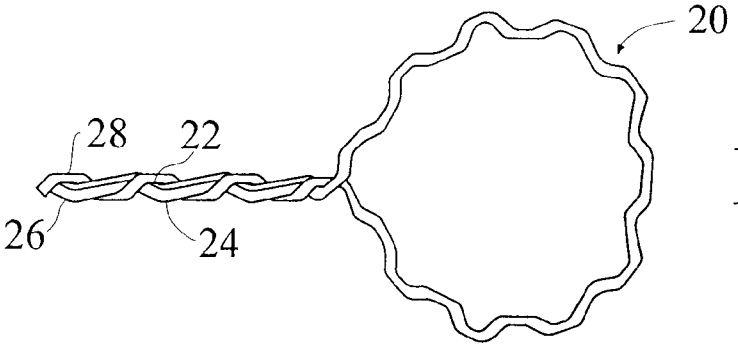
FIG. 3 is a side elevational view of the pre-crimped component of FIG. 1 with its ends intertwined.
Figure 4:
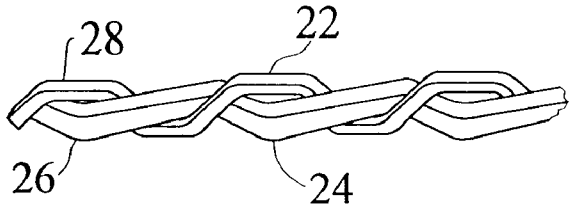
FIG. 4 is an exploded, isometric view of the intertwined portions of FIG. 3.

Referring to FIGS. 2–4, a first configuration of tying of the component 20 is shown. The ends 26, 28 of the component 20 are crisscrossed as illustrated in FIG. 2. The ends 26, 28 are then rotated relative to one another such that the indentations 22 and projections 24 register with one another and interlock as illustrated in FIGS. 3 and 4. The strength of the interlocking is controlled by the size of the component, the type of material from which it is formed, the frequency of the crimping, the width and depth of the indentations 22 and projections 24, and the area of intertwining. The depth of the indentations 22 is the interior distance from the bottom of an indentation to the top of an adjacent projection. The width of the indentation 22 is the interior distance from one projection to the next. For example, a tie component was formed in a thermoforming process. Round stock of 1.4 mm diameter nylon monofilament was thermoformed to provide a resultant component having a generally rectangular cross-section, roughly 0.95 mm thick by 1.95 mm wide. It was found that a crimp deformation of between 3 and 3.5 mm (the distance between the outer surface of one projection and the outer surface of an oppositely facing projection) and a crimp frequency of 3 to 4 indentations/cm provided desirable results. Other materials and configurations may also be used, for example, with different crimp spacing and size.

Preferably, to obtain high fastening strength, the width and depth of the receiving indentations are approximately equal to the width and thickness of rectangular or non-round component, or the diameter of a circular component. The indentations then positively hold the component yarn and can reduce occurrence of premature undesired release.

A tie component 20 intertwined as illustrated in FIGS. 2–4 can be used for a number of end uses. For example, it can be used as suspended ceiling ties, cable ties, plant hangers, pole ties, tool peg board holder, or as a general faster anywhere a twist-tie or the like maybe used. Additionally, since numerous materials can be used, a component 20 manufactured from nylon or the like can be used in high temperature applications, for example, as a cable or hose tie for use in an engine compartment.

Figure 5:
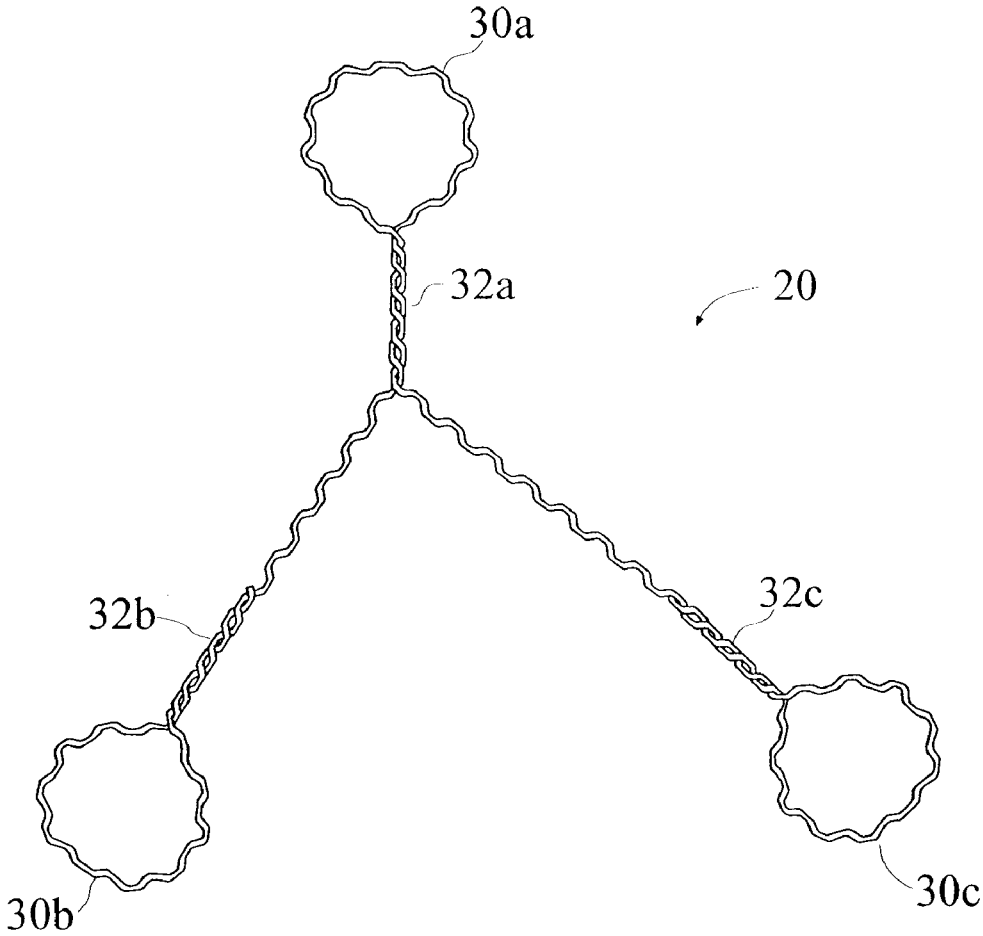
FIG. 5 illustrates a pre-crimped component according to the present invention intertwined to form a multi-loop component.

An alternate tying configuration is illustrated in FIG. 5. In this example, the component 20 is intertwined at multiple locations 32*a*, 32*b*, and 32*c* to define multiple tie loops 30*a*, 30*b*, and 30*c*. Such a configuration allows multiple objects to be interconnected with a single tie component 20. Any number and configuration of tie loops 30 can be defined. Additionally, such flexibility allows the component 20 to be used in various ways, for example, as a plant hanger or the like.

Figure 7:
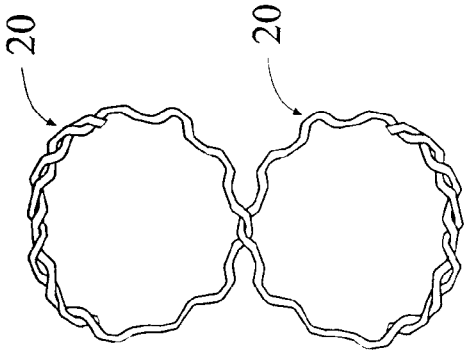
FIG. 7 illustrates two interconnected pre-crimped components of the present indentation.
Figure 6:
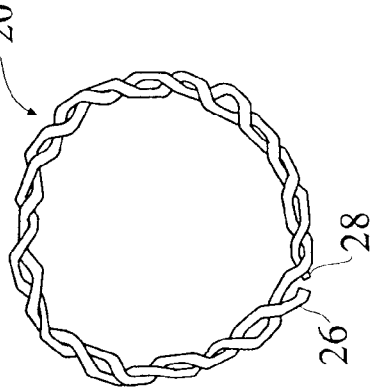
FIG. 6 illustrates a pre-crimped component according to the present invention intertwined into a circular unit.

Another alternate tying configuration is illustrated in FIGS. 6 and 7. Referring to FIG. 6, each end 26, 28 of the component 20 is intertwined with the body of the component 20 to define a generally circular ring. The extent to which the ends 26, 28 are intertwined can be varied, as can be seen by comparing FIGS. 6 and 7. As shown in FIG. 7, multiple rings can be interconnected to define a link chain or the like. The ringed components show surprising strength.

In a test, two 12 inch pre-crimped components 20 were formed into loops and joined as illustrated in FIG. 7. The pre-crimped components were formed from the 1.4 mm diameter round polyamide 6 monofilament described above which was subsequently crimped to a deformation of 3–3.5 mm at 3–4 indentations per cm. The loops were formed by intertwining a 2 inch length of the component 20 from each opposing end 26, 28. The two loops were then pulled apart using an Instron tensile testing machine. A force of about 11 kg was required to cause the indentations and projections of the joined areas of the components 20 to begin to slide and pull apart.

As a comparison, two ½ inch wide by 11 inch long strips of Velcro® fastening material were joined in a similar manner so that approximately two inches of material overlapped. The material used in the test was Ultra-Mate brand fastener, part number 161293 HTH ½ in.×11 in. perfed strap material. The two Velcro® loops were interconnected in a "FIG. 8" configuration like the pre-crimped components described above. The Velcro® loops were then pulled apart using the same Instron tensile testing apparatus. The force required to pull the Velcro® loops apart was also about 11 kg.

As illustrated by the test, the intertwined pre-crimped components 20 demonstrated equal strength to the Velcro® loops even though they were significantly smaller in size and in the binding area along each loop.

In each tying configuration, the tie component 20 can be removed simply by untwisting the ends 26 and 28. The component 20 can then be reused in any desired manner. Furthermore, the tying configurations and applications described above are set forth only for the purposes of illustration and are not intended to be limiting. Other tying configurations and applications are within the scope of this invention.

Figure 8:
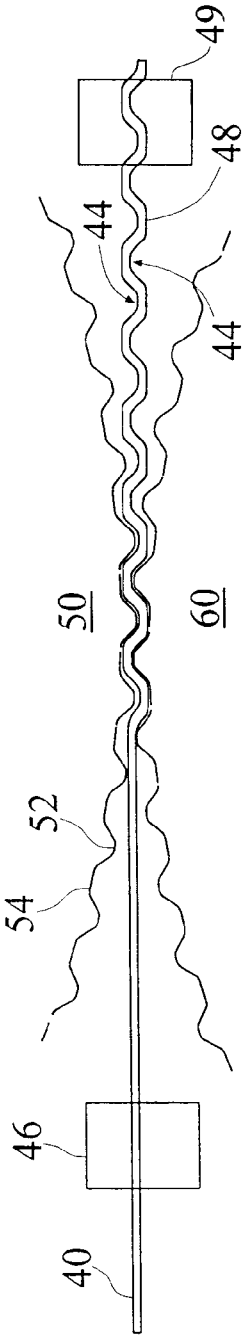
FIG. 8 illustrates a preferred method of manufacturing the component of FIG. 1.

The presently preferred method of forming pre-crimped components will be described with reference to FIG. 8. Raw stock 40, such as uncrimped, polymeric yarn is passed through opposed forming gears 50, 60 having respective predetermined projections 52 and recessions 54. In addition to using opposed gears, various other assemblies, for example cams, embossing rolls, or crimping plates can be utilized.

Depending on the stock material, the size of the components and the desired indentation size, it may be desirable to heat the raw stock 40 to make it more pliable prior to passage through the crimping means. An appropriate temperature may be selected for each polymer with the stock 40 preferably being heated to approximately the glass transition temperature of the polymer material. For some polymers, for example, PET, heating may not be necessary and/or desired. In the preferred embodiment, a heat source 46 is positioned proximate to the gears 50, 60 and controlled to provide a desired amount of heat. Various heat sources 46 can be used including a hot water bath, a conduction or convection oven, a microwave or infrared radiation. Alternatively, the gears 50, 60 may be heated, for example by using a cartridge heater or other suitable heat source, to heat the stock 40 as it is crimped. Alternatively, the stock 40 may be fed to the gears 50, 60 directly from the apparatus used for forming such, for example a spinnerette or extruder, in a semi-heated state where it may or may not require additional heat.

If heated, the crimped component 48 is preferably readily cooled by a suitable means to assure that the size and shape of the imparted crimp is retained. In one embodiment, the heated crimped component 48 is passed through a cold water bath or vortex chiller 49. Alternatively, the primary gears 50, 60, or a supplemental set of gears (not shown) may be chilled, for example by a vortex chiller, to cool the exiting component 48. If a second, cooled gear assembly or the like is used, it will have projections and recesses complementary to those of the first gear and will be synchronized therewith. In some applications, rapid cooling may not be necessary and the component may be allowed to stand and cool naturally.

The finished crimped component 48 is then either coiled into a suitable package, with a user later cutting pieces to a desired length or the component may be cut into predefined lengths and packaged.

What is claimed is:

1. A tie component comprising a polymeric material element pre-crimped along an entire length thereof with a plurality of alternating indentations and projections, the material element including first and second portions that are joined by alignment and relative movement with respect to one another such that a plurality of the first portion projections engage a corresponding plurality of the second portion indentations and a plurality of the second portion projections engage a corresponding plurality of the first portion indentations, the indentations having an opening sized to accept a width of the material element so as to lock the first and second portions together.

2. A tie component according to claim 1 comprised of a polymeric material.

3. A tie component according to claim 2 wherein the polymeric material comprises at least one of PET, Nylon, PBT, PPO, PPS, PCTA and PEEK, and copolymers thereof.

4. A tie component according to claim 1 wherein the component has a cross sectional shape selected from the group comprising round, oval, triangular, rectangular, square and trapezoidal.

5. A tie component according to claim 1 wherein the component is comprised of a yarn selected from the group of monofilainents, multifilaments, bicomponents and spun yarns.

6. A tie component according to claim 1 wherein the precrimped portions are thermoformed.

7. A tie component according to claim 1 wherein the precrimped portions are molded.

8. A tie component according to claim 1, wherein a width and a depth of the indentations is approximately equal to a width and a thickness of the material element.

9. A tie component according to claim 1, wherein the tie component has a generally rectangular cross-section, and the width of the indentations is approximately equal to a width of the rectangular cross-section.

10. A tie component according to claim 1, wherein the tie component is cut to a desired length from the pre-crimped polymeric material element, and the first and second portions are provided at any location along the length.

* * * * *